US006821037B2

(12) United States Patent
Sakurai et al.

(10) Patent No.: US 6,821,037 B2
(45) Date of Patent: Nov. 23, 2004

(54) PRINTING DEVICE PROVIDED WITH CUTTER TO CUT RECORDING PAPER

(75) Inventors: Kunihiko Sakurai, Gifu (JP); Norio Mizutani, Mie-ken (JP); Naomi Yamamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/424,688

(22) Filed: Apr. 29, 2003

(65) Prior Publication Data

US 2003/0202835 A1 Oct. 30, 2003

(30) Foreign Application Priority Data

Apr. 30, 2002 (JP) ..... 2002-128261

(51) Int. Cl.[7] ..... B41J 11/26

(52) U.S. Cl. ..... 400/621; 400/593; 358/1.1

(58) Field of Search ..... 400/621, 611, 400/61, 62, 70, 76; 358/1.1–1.9, 1.16, 1.17

(56) References Cited

U.S. PATENT DOCUMENTS 5,398,305 A * 3/1995 Yawata et al. ..... 358/1.1
5,531,530 A * 7/1996 Kuramoto et al. ..... 400/593
5,639,169 A * 6/1997 Aruga ..... 400/605
6,141,028 A * 10/2000 Aruga ..... 347/193

* cited by examiner

*Primary Examiner*—Minh Chau
(74) *Attorney, Agent, or Firm*—Oliff & Berridge, PLC

(57) ABSTRACT

A setup application outputs a settings file in which are entered paper types and cutting modes. A print data generated by a design application is appended with data indicating a cutting mode appropriate to the print data and transmitted to a printer. Upon reception of the print data, the printer prints images on a recording paper based on the print data and cuts the recording paper in the cutting mode indicated by the appended data.

28 Claims, 9 Drawing Sheets

CONFIGURATION OF SOFTWARE PROGRAMS IN THE PERSONAL COMPUTER

CONFIGURATION OF SOFTWARE PROGRAMS IN THE PRINTER

48

| PAPER TYPE | CUTTING MODE |
|---|---|
| NORMAL | 1 |
| THICK PAPER | 2 |
| CLOTH | 0 |
| FILM | 0 |
| ⋮ | ⋮ |

60 62

PRINTING DEVICE PROVIDED WITH CUTTER TO CUT RECORDING PAPER

BACKGROUND OF THE INVENTION

1. Field of the Invention

The present invention relates to a printing device including a function for cutting recording paper.

2. Description of the Related Art

Large printers called wide format printers generally use roll-type recording paper as the printing medium. Wide format printers using this roll-type paper are equipped with cutters for cutting paper after the paper is printed. Obviously, paper is a common material used in the roll-type recording medium, but non-paper materials, such as cloth and vinyl, are also widely used. Often users wish to use recording paper having special characteristics, such as glossiness and weather resistance, in this type of wide format printer in order to create advertisement displays, for example. Therefore, recording paper other than genuine products provided by the manufacturer of the wide format printer is often used However, the cutter provided in the wide format printer is normally designed to cut paper media or manufacturer-specific recording media and may result in damage to the cutter or recording media when cutting a medium other than these types. Accordingly, it is necessary to prevent the cutter from operating when printing on other types of recording media. This is accomplished by disabling the cutting action via a control panel on the wide format printer.

However, since the user must specify whether or not the cutter should be operated after determining the type of paper to be printed on, it is not uncommon for the user to forget to change this setting, resulting in damage to the cutter or to the paper and often leading to malfunctions of the printer itself.

Further, sometimes the recording medium cannot be cut properly without changing the cutting mode to suit the characteristics of the recording medium, particularly when the medium is thick or heavy. The paper is cut according to a method of feeding the paper until the printed portion has passed by the cutting position and then cutting the printed portion of the paper away from the non-printed portion. In order to produce a more compact printer, some manufacturers have eliminated a receiving surface of the wide format printer that serves to support the printed portion of the paper passing the cutting position. In this type of wide format printer, the printed portion of the paper hangs down by its own weight. When cutting paper that hangs down by its own weight, particularly when the paper is heavy, the cutter cannot always cut the paper accurately according to the conventional cutting method. That is, when performing a single cut from one widthwise side of the paper to the other, the center of gravity of the paper may shift during the cutting operation, causing the paper to rotate, often resulting in the paper tearing from its own weight or producing an uneven cut. These problems become more remarkable when using a wider paper, such as A0-size paper.

For this case, another cutting method was conceived in which the process is divided into three cuts. First a cut is made toward the right edge beginning just right of center, for example. Then, a second cut is made toward the left edge, beginning just left of center. Finally, the remaining center portion is cut. This cutting method eliminates the likelihood of paper tears caused by the paper's own weight or uneven cuts produced when the center of gravity shifts and the paper rotates, because the center portion of the paper, which is the center of gravity when the paper is in a hanging state, is connected to the unprinted portion of the paper until the final cut.

However, the method is problematic in that more cutting time is required since the process is divided into three cuts. Another disadvantage of this method is that junctures are formed along the cutting line due to errors in cutting precision. Further, when using lighter paper with which shifts in center of gravity and the like are not a problem, it is better to cut the paper with a single cut in order to cut the paper smoothly and quickly.

While it is conceivable to provide a wide format printer capable of being switched between cutting modes according to the type of paper being used, this printer has not come into widespread use because the user must perform complex operations on the printer for entering a paper cutting mode and must change the mode each time the paper type is changed.

SUMMARY OF THE INVENTION

In view of the foregoing, it is an object of the present invention to overcome the above problems and also to provide a print instructing device and a printing device capable of greatly reducing damage to a cutter and paper.

In order to attain the above and other objects, the present invention provides a print instructing device communicable with a printing device that performs a printing on various types of recording medium and that is provided with a cutter to cut the recording medium. The print instructing device includes a storing unit that stores a plurality of data sets each indicating one of cutting operations for a corresponding type of recording medium and a transmitting unit that transmits a print data appended with one of the data sets to a printing device. The print data instructs the printing device to perform a printing on a recording medium. The one of the data sets instructs the printing device to perform a corresponding one of the cutting operations to the recording medium.

There is also provided a printing device including a receiving unit that receives a print data appended with a setting data from a print instructing device, the setting data indicating a type of recording medium and a cutting operation, a printing unit that performs a printing operation on one of a plurality of types of recording medium, the printing unit performing the printing operation based on the print data on a recording medium of the type indicated by the setting data, and a cutting unit that performs a cutting operation to the recording medium based on the setting data.

There is also provided a print instructing device communicable with a printing device that performs a printing on various types of recording medium and that is provided with a cutter to cut the recording medium. The print instructing device includes a transmitting unit that transmits a print data appended with a classification data to a printing device. The classification data indicates one of a plurality of types of recording medium, and the print data instructs the printing device to perform a printing operation on a recording medium of the type indicated by the classification data.

There is also provided a printing device including a receiving unit that receives a print data appended with a classification data from a print instructing device, the classification data indicating one of a plurality of types of recording medium, a printing unit that performs a printing on one of a plurality of types of recording medium, the printing unit performing, based on the print data, the printing on a recording medium of the type indicated by the classification data, a storing unit that stores a setting data indicating cutting operations for each type of recording medium, and a cutting unit that performs one of a plurality of cutting operations to the recording medium based both on the classification data and the setting data.

There is also provided a control program of controlling a print instructing device communicable with a printing device that performs a printing on various types of recording medium and that is provided with a cutter to cut the recording medium. The control program includes the programs of storing a plurality of data sets each indicating one of cutting operations for a corresponding type of recording medium, and transmitting a print data appended with one of the data sets to a printing device. The print data instructs the printing device to perform a printing on a recording medium, and the one of the data sets instructs the printing device to perform a corresponding one of cutting operations to the recording medium.

There is also provided a control program of controlling a printing device. The control program includes the programs of receiving a print data appended with a setting data from a print instructing device, the setting data indicating a type of recording medium and a cutting operation, controlling a printing unit to perform a printing operation based on the print data on a recording medium of the type indicated by the setting data, and controlling a cutting unit to perform a cutting operation to the recording medium based on the setting data.

There is also provided a control program of controlling a print instructing device communicable with a printing device that performs a printing on various types of recording medium and that is provided with a cutter to cut the recording medium. The control program includes the program of transmitting a print data appended with a classification data to a printing device. The classification data indicates one of a plurality of types of recording medium, and the print data instructs the printing device to perform a printing operation on a recording medium of the type indicated by the classification data.

There is also provided a control program of controlling a printing device. The control program includes the programs of storing a setting data indicating cutting operations for each type of recording medium, receiving a print data appended with a classification data from a print instructing device, the classification data indicating one of a plurality of types of recording medium, controlling a printing unit to perform, based on the print data, a printing on a recording medium of the type indicated by the classification data, and controlling a cutting unit to perform one of a plurality of cutting operations to the recording medium based both on the classification data and the setting data.

There is also provided a print system including a print instructing device and a printing device. The print instructing device includes a storing unit that stores a plurality of data sets each indicating one of cutting operations for a corresponding type of recording medium, and a transmitting unit that transmits a print data appended with one of the data sets to the printing device. The printing device includes a receiving unit that receives the print data appended with the one of the data sets, a printing unit that performs a printing operation on one of a plurality of types of recording medium, and a cutting unit that performs one of the plurality of cutting operations. The printing unit performs, based on the print data, on a recording medium of the type indicated by the one of the data sets, and the cutting unit performs the one of the plurality of cutting operations to the recording medium, the one of the plurality of cutting operations being indicated by the one of the data sets.

There is also provided a print system including a printing device and a print instructing device including a transmitting unit that transmits a print data appended with a classification data to the printing device. The classification data indicates one of a plurality of types of recording medium to be printed on. The printing device includes a receiving unit that receives the print data appended with the classification data, a storing unit that stores a setting data indicating cutting operations for each type of recording medium, a printing unit that performs a printing on one of a plurality of types of recording medium, and a cutting unit. The printing unit performs, based on the print data, the printing on a recording medium of the type indicated by the classification data, and the cutting unit performs one of a plurality of cutting operations to the recording medium based both on the classification data and the setting data.

PREFERRED EMBODIMENTS OF THE PRESENT INVENTION

Next, printing systems according to embodiments of the present invention will be described while referring to the accompanying drawings.

Figure 1:
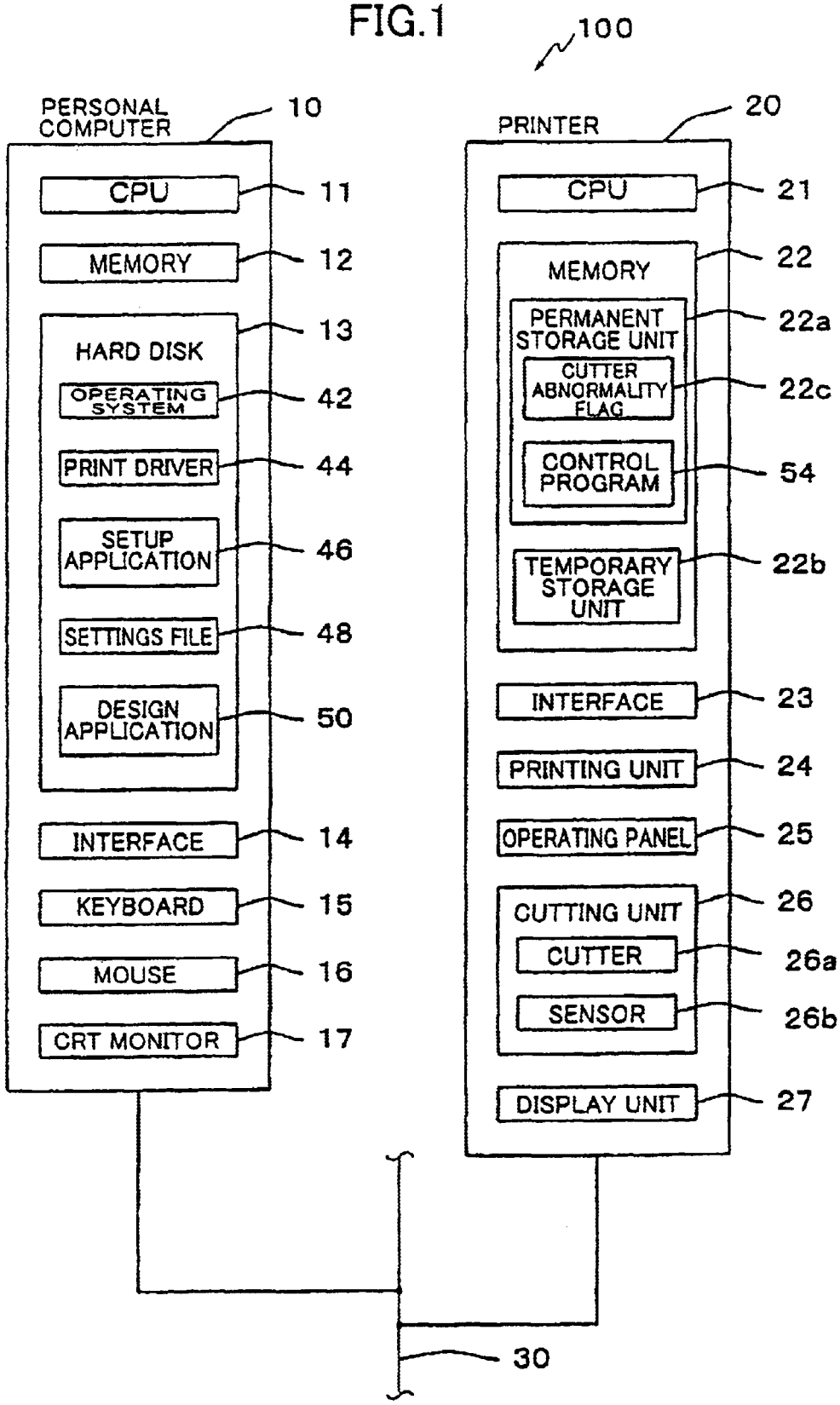
FIG. 1 is a block diagram showing the general construction of a printing system according to a first embodiment.

FIG. 1 is a block diagram showing the overall construction of a printing system 100 according to a first embodiment of the present invention. The printing system 100 includes a personal computer 10 and a printer 20. The personal computer 10 and the printer 20 can communicate with each other via a local area network (LAN) 30.

The personal computer 10 includes a central processing unit (CPU) 11, a memory 12, a hard disk 13, an interface (I/F) 14, a keyboard 15, a mouse 16, and a cathode ray tube (CRT) monitor 17. The CPU 11 executes software programs. The memory 12 is provided for developing such programs for the CPU 11 to execute and for temporarily saving various data, including print data. Programs and data saved in the memory 12 are lost when the power of the personal computer 10 is turned OFF. The hard disk 13 stores various programs and data. The programs include an operating system (OS) 42, a print driver 44, a setup application 46, and a design application 50, while the data includes a settings file 48. Programs and data can be saved in the hard disk 13 even when the power of the personal computer 10 is turned OFF. The interface 14 functions to provide communications between the personal computer 10 and the printer 20. The keyboard 15 and the mouse 16 receive input through operations by the user. The CRT monitor 17 displays various data.

The printer 20 includes a CPU 21, a memory 22, an interface 23, a printing unit 24, an operating panel 25, a cutting unit 26, and a display unit 27. The CPU 21 executes software programs. The memory 22 includes a permanent storage unit 22*a* formed of a rewritable, non-volatile storage device, such as flash memory, and a temporary storage unit 22*b* formed of a volatile storage device, such as Dynamic RAM (DRAM). The permanent storage unit 22*a* stores programs, including a control program 54, and flags, such as a cutter abnormality flag 22*c*. The temporary storage unit 22*b* temporarily stores various data, including print data. The interface 23 functions to provide communications between the printer 20 and the personal computer 10. The printing unit 24 includes ink, a print head, a paper feeding mechanism, and the like and is capable of printing on a roll-type recording paper. The operating panel 25 receives input operations from the user, enabling the user to input information for regulating the printer 20 and the like. The cutting unit 26 includes a cutter 26*a* and a sensor 26*b*. The cutter 26*a* functions to cut a portion of the roll-type paper printed by the printing unit 24 from the non-printed portion of the paper. The sensor 26*b* detects abnormalities in operations of the cutter 26*a*. The display unit 27 is formed of a liquid crystal panel and serves to display various information.

Figure 2A:
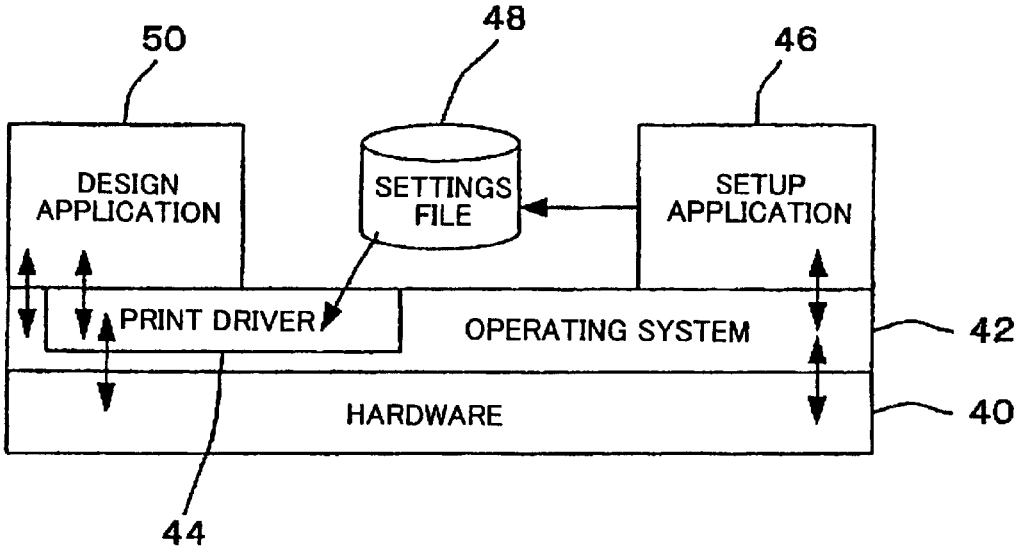
FIGS. 2(*a*)–2(*b*) are explanatory diagrams showing the general configuration of software programs in the first embodiment.
Figure 2B:
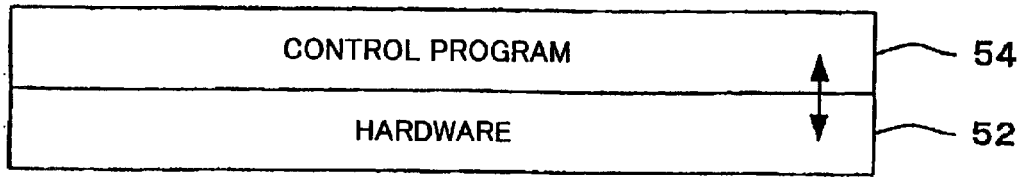

Next, the configuration of software programs used in the printing system 100 of the present embodiment will be described. FIG. 2(*a*) is an explanatory diagram showing the general configuration of software programs used in the personal computer 10. The personal computer 10 executes such software programs as the operating system 42, the print driver 44, the setup application 46, and the design application 50. The operating system 42 controls hardware 40, including the CPU 11, the memory 12, the hard disk 13, the interface 14, the keyboard 15, the mouse 16, and the CRT monitor 17. The design application 50 is an application program for designing printed materials. The user designs printed material using the design application 50 to generate print data. The setup application 46 is an application program that the user executes to set a recording paper type and a cutting mode in which the printer 20 cuts a recording paper of the type. When the user sets a recording paper type and a cutting mode for the recording paper type using the setup application 46, the settings file 48 describing the settings is outputted. The print driver 44 functions as part of the operating system 42 by receiving print data from the design application 50, reading the settings file 48, controlling the hardware 40 (essentially the interface 14) to transmit instructions to the printer 20.

FIG. 2(*b*) is an explanatory diagram showing the general configuration of software programs used in the printer 20. Programs used in the printer 20 include the control program 54 for controlling hardware 52. Here, the hardware 52 includes the CPU 21, the memory 22, the interface 23, the printing unit 24, the operating panel 25, the cutting unit 26, and the display unit 27.

Below, detailed operations by the personal computer 10 and the printer 20 according to these software programs will be described. However, a description of software programs well known in the art, such as the design application 50 and the operating system 42, will be omitted.

Figure 3:
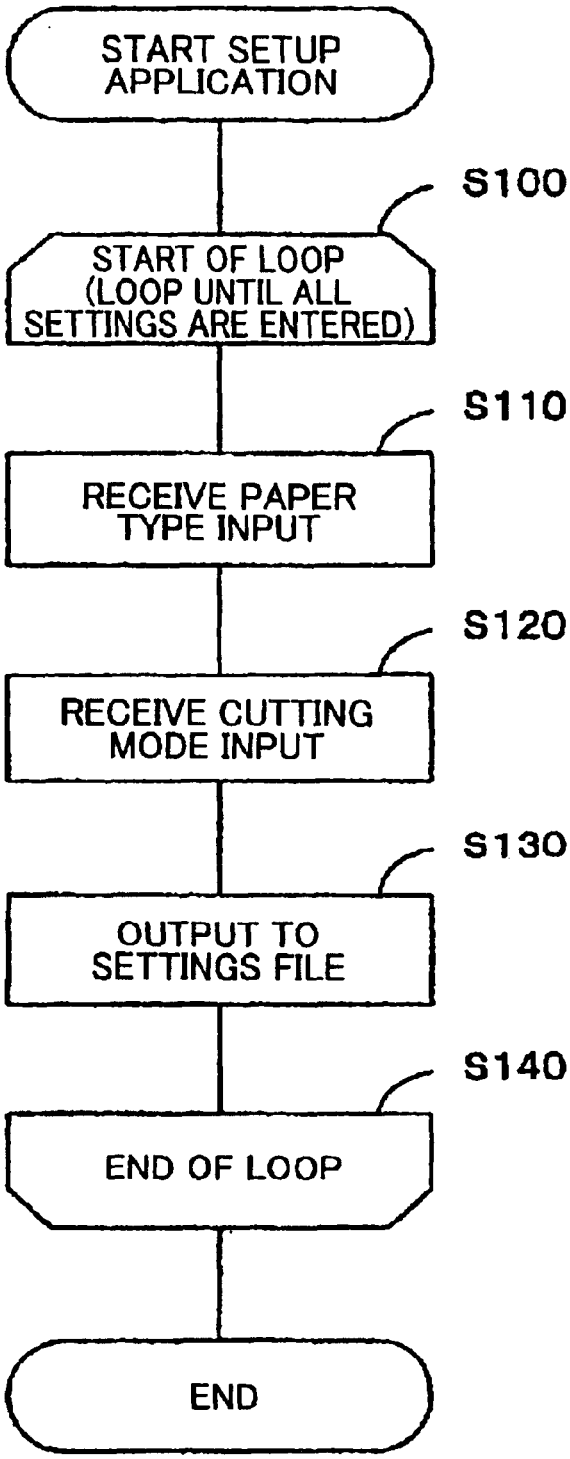
FIG. 3 is a flowchart showing steps in the setup application process according to the first embodiment.

First, the setup application 46 will be described. The setup application 46 can be executed at any time the user wishes (for example, the first time the user performs a print operation). Using the keyboard 15 or the mouse 16, the user indicates a desire to execute the program. By doing so, the setup application 46 is read from the hard disk 13, developed in the memory 12, and executed by the CPU 11. FIG. 3 is a flowchart representing the process of the setup application 46.

To begin with, in S100, a loop setting is executed to repeatedly perform processes in S110–S130. In S110, an input screen is displayed on the CRT monitor 17 prompting the user to input a paper type. After data indicating a paper type is received through input by the keyboard 15 or the mouse 16, the information is saved temporarily in the memory 12.

In S120, a screen is displayed on the CRT monitor 17 prompting the user to input a cutting mode. After receiving data indicating the cutting mode through input from the keyboard 15 or the mouse 16, the information is temporarily saved in the memory 12. The cutting modes are described later.

Figures 4, 5:
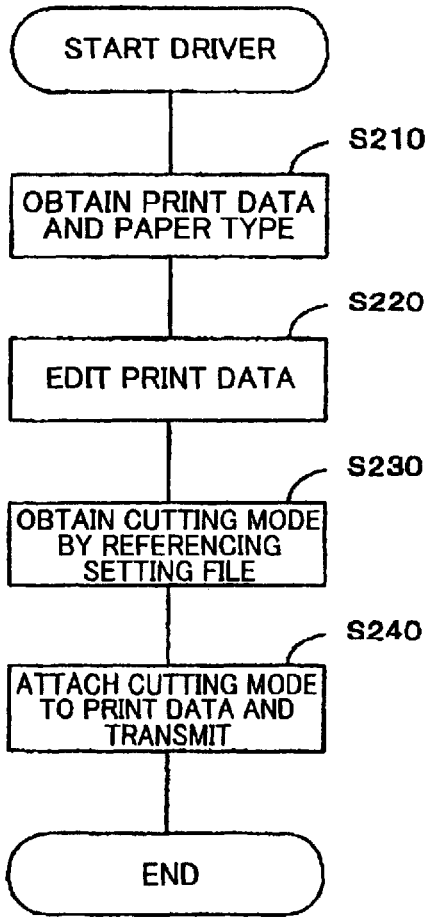
FIG. 4 is an explanatory diagram showing an example of a settings file.
FIG. 5 is a flowchart showing steps in the print driver process according to the first embodiment.

In S130, data for the paper type and cutting mode inputted in S110 and S120 are outputted to the settings file 48. As shown in FIG. 4, the settings file 48 includes a paper type column 60 and a cutting mode column 62. For example, the cutting mode is "1" when the paper type is "normal." The cutting mode is "2" when the paper type is "thick paper." The cutting mode is "0" when the paper type is "cloth" and "film." Here, the cutting mode "0" indicates not to perform a cutting operation by using the cutter 26*a* of the printer 20. The cutting mode "1" indicates a cutting method in which the cutter 26*a* is operated once to perform a single, linear cut in one direction. The cutting mode "2" indicates a cutting method for first cutting both widthwise ends of the paper at the cutting position and subsequently cutting the remaining center portion. The cutting mode "2" is used on heavy paper and wide paper, such as A0 size paper. Here, the paper manufacturer's name and product name can also be inputted as the paper type.

Returning to FIG. 3, in S140 if there are more settings to be made for paper types and cutting modes, that is, if the above processes are to be repeated, then the process returns to S100. However, if there are no more settings to be made, then the loop is exited and execution of the setup application 46 also ends.

Next, the process of the print driver 44 will be described. Upon receiving a print request from the design application 50, the print driver 44 is read from the hard disk 13, developed in the memory 12, and executed by the CPU 11. FIG. 5 is a flowchart representing the process of the print driver 44.

In S210, the paper-type data and the print data set by the design application 50 are acquired from the design application 50. Normally, the design application 50 opens a print setup window prior to transferring a print request to the print driver 44, enabling the user to set the type of paper to be printed on.

In S220, the acquired print data is edited. For example, a process for adjusting the printing density, a process for arranging the layout, or a raster image process (RIP) is executed. Subsequently, the print data is converted to control codes for directly controlling the printer 20. In S230, the settings file 48 outputted by the setup application 46 described above is referenced so as to acquire the cutting mode corresponding to the paper type indicated by the paper-type data acquired in S210.

In S240, mode data indicating the acquired cutting mode is attached to the print data (now converted to control codes), transmitted to the printer 20, and execution of the print driver 44 ends.

Figure 6:
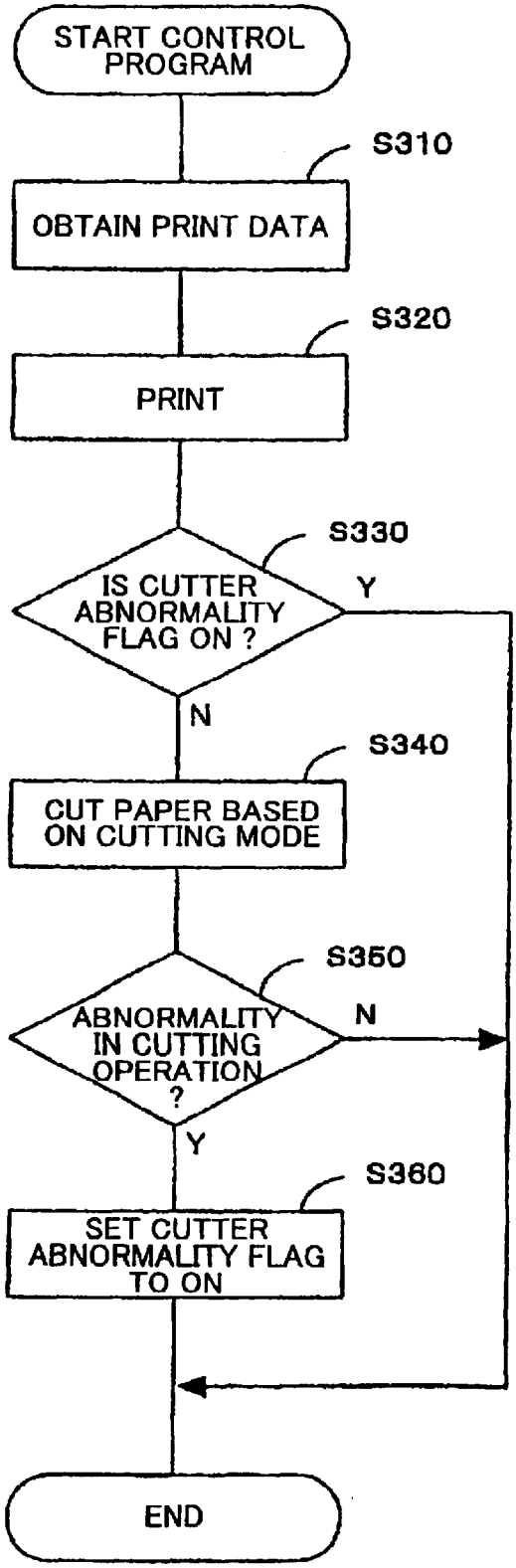
FIG. 6 is a flowchart showing the steps in the process of a control program according to the first embodiment.

Next, the control program 54 will be described with reference to FIG. 6. The CPU 21 executes the control program 54 when print data (converted to control codes) is received from the print driver 44 of the personal computer 10. In this embodiment, the print data attached with mode data is received. It is also possible to start the control program 54 by transmitting a start command from the print driver 44 separately from the print data.

First, in S310, print data (control codes) is acquired from the print driver 44 and temporarily stored in the temporary storage unit 22*b* of the memory 22. In S320, the printing unit 24 is directed to perform a printing process based on the print data acquired in S310.

In S330, the CPU 21 determines whether or not the cutter abnormality flag 22*c* is ON. If so (S330:YES), then the remaining processes are skipped and execution of the control program 54 ends. On the other hand, if not (S330:NO), then the process advances to S340. Here, the cutter abnormality flag 22*c* is a flag indicating the status of the cutter 26*a*. Since the cutter abnormality flag 22*c* is stored in the permanent storage unit 22*a* of the memory 22, this status is preserved even when the power supply to the printer 20 is cut OFF, provided that the user does not change the value through operations on the operating panel 25.

In S340, the CPU 21 instructs the cutter 26*a* to cut the printed portion of the paper from the non-printed portion using the corresponding cutting method based on the mode data attached to the print data. In S350, the CPU 21 determines whether the sensor 26*b* detected some operating abnormality when the cutter 26*a* cut the paper in S340. If an abnormality was detected (S350:YES), then the process proceeds to S360. If an abnormality was not detected (S350:NO), then execution of the control program 54 ends. Abnormalities can include failure of the cutter 26*a* to return to its original position and stoppages of the cutter 26*a* for a predetermined length of time or more during the operation.

In S360, the cutter abnormality flag 22*c* is set to ON and a message is displayed on the display unit 27 indicating that an abnormality occurred when the cutter 26*a* was cutting the paper. Subsequently, execution of the control program 54 ends.

As described above, since the personal computer 10 transmits mode data indicating a cutting mode for the targeted paper to the printer 20, the user need not set a cutting mode by operating the printer 20. Accordingly, the present invention can reduce damage to the cutter 26*a* and the paper caused by incorrect operations by the user.

Further, since the user can set the settings file 48 using the keyboard 15 and the mouse 16, it is easy to enter and modify settings, making the present invention very user-friendly. Further, since the settings file 48 can include data regarding whether or not to perform a cut using the cutter 26*a* (S330:YES), it is possible to print on sheets that cannot be cut, by indicating not to cut (specifically, setting the cutting mode to "0").

Further, the cutter 26*a* is prevented from cutting paper after the sensor 26*b* detects an abnormality in the cutter 26*a*. Hence, when some abnormality occurs, such as the cutting performance drops due to wear and tear of the cutter 26*a*, it is possible to prevent damage to the paper and to the cutter 26*a* itself that could occur if the printer 20 were to continue cutting in its present state.

Next, a second embodiment of the present invention will be described, focusing only points differing from the first embodiment.

Figure 7:
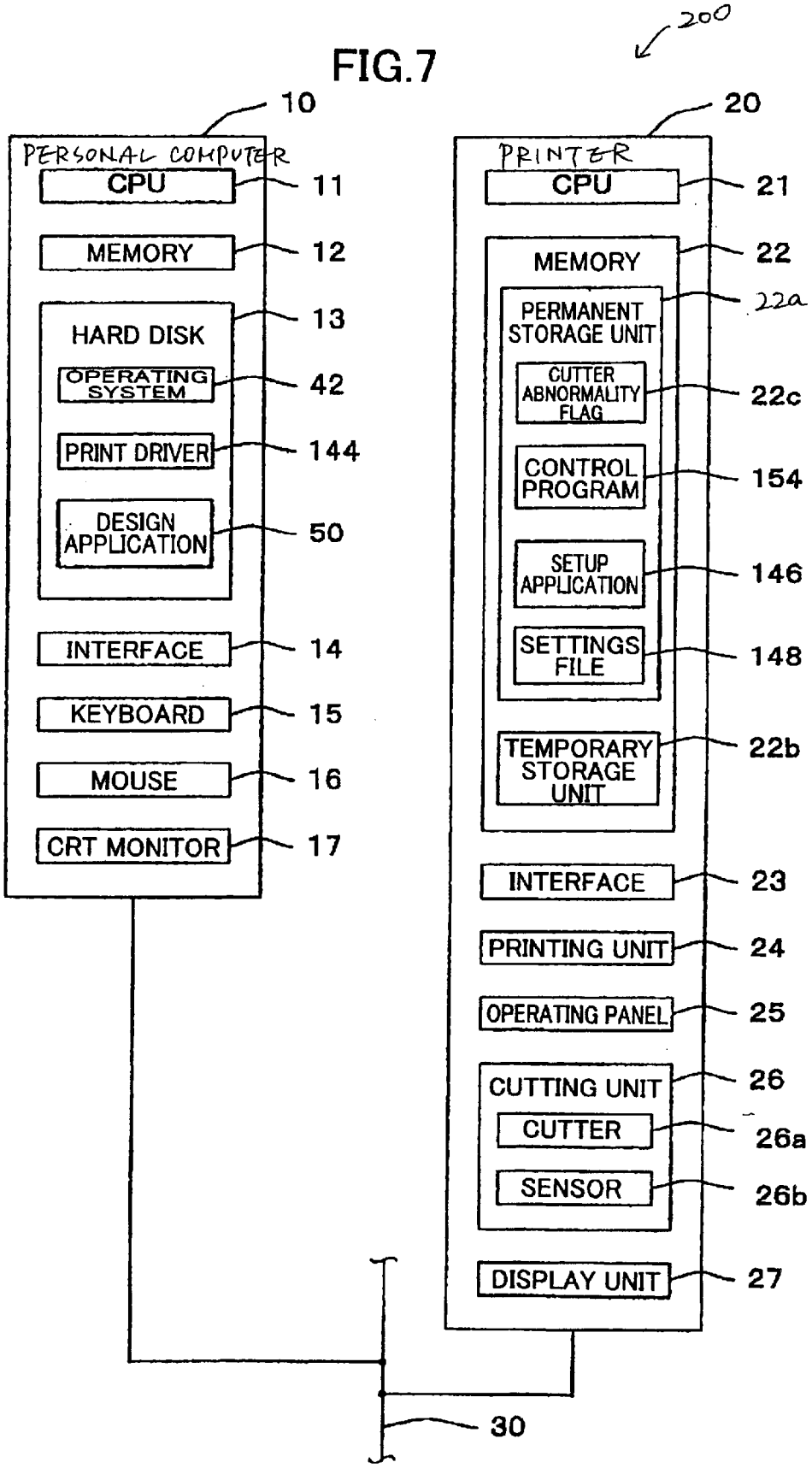
FIG. 7 is a block diagram showing the general construction of a printing system according to a second embodiment.

FIG. 7 is a block diagram showing the general construction of a printing system 200 according to the second embodiment. Similar to the first embodiment, the printing system 200 of the second embodiment includes the personal computer 10 and the printer 20. The personal computer 10 and the printer 20 can communicate with each other via the LAN 30. Parts and components that function similar to those in the first embodiment are given the same numeral and description thereof will be omitted to avoid duplicating description.

In the first embodiment, the setup application 46 and the settings file 48 are provided in the hard disk 13 of the personal computer 10. However, in the second embodiment, as shown in FIG. 7, a setup application 146 and a settings file 148 are provided in the memory 22 (more specifically the permanent storage unit 22*a* of the printer 20).

Figure 8A:
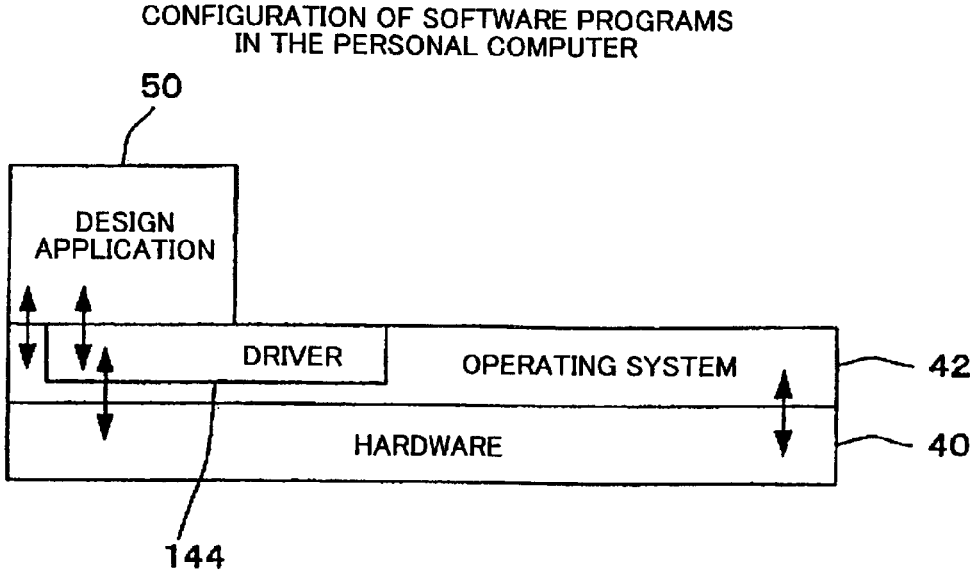
FIGS. 8(*a*)–(*b*) are explanatory diagrams showing the general configuration of software programs in the second embodiment.
Figure 8B:
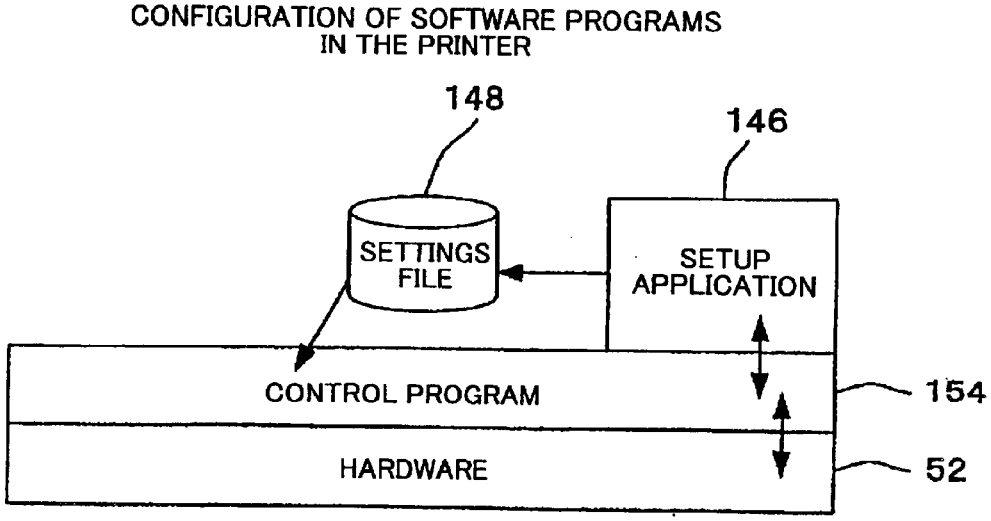

The general configurations of software programs in the personal computer 10 and the printer 20 are shown in FIGS. 8(*a*) and 8(*b*), respectively. As shown in FIG. 8(*a*), the configuration of programs in the personal computer 10 includes the operating system 42, a driver 144, and the design application 50. The operating system 42 controls the hardware 40, including the CPU 11, the memory 12, the hard disk 13, the interface 14, the keyboard 15, the mouse 16, the CRT monitor 17, and the like. The design application 50 is a software application for designing printed materials. The user uses the design application 50 to design printed materials in order to generate print data. The driver 144 functions as part of the operating system 42 by receiving print data and paper-type data from the design application 50 and controlling the hardware 40 (essentially the interface 14) to transmit commands to the printer 20.

As shown in FIG. 8(*b*), the configuration of programs in the printer 20 includes a control program 154 and the setup application 146. The control program 154 controls the hardware 52, including the CPU 21, the memory 22, the interface 23, the printing unit 24, the operating panel 25, the cutting unit 26, the display unit 27, and the like. The setup application 146 receives data via the control program 154 for a paper type and the cutting mode for the paper type that are inputted by the user via the hardware 52 (essentially the operating panel 25), and outputs this data to the settings file 148. The control program 154 uses the settings file 148, and print data and paper-type data transmitted from the personal computer 10, and controls the hardware 52 (essentially the printing unit 24 and the cutting unit 26) to perform a printing operation and to cut the printed paper.

Next, operations executed by the personal computer 10 and the printer 20 according to these software programs will be described. However, operations performed by software well known in the art, such as the design application 50 and operating system 42, have been omitted.

Figure 9:
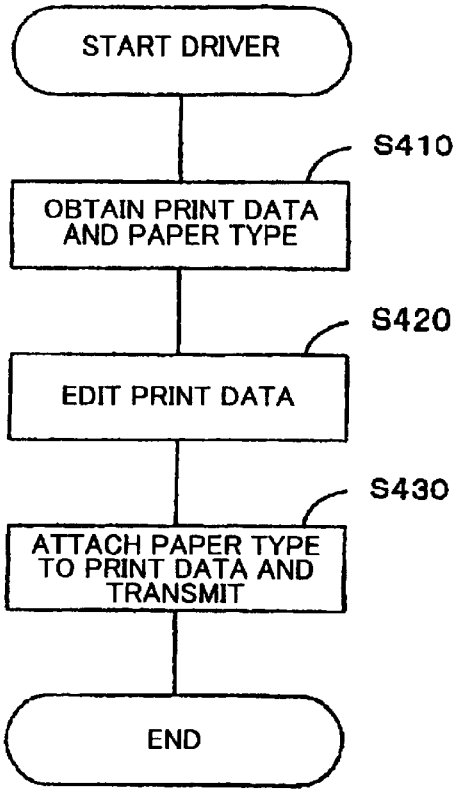
FIG. 9 is a flowchart showing steps in the print driver process according to the second embodiment.

First, the driver 144 will be described. When a print request is received from the design application 50, the driver 144 is read from the hard disk 13, developed in the memory 12, and executed by the CPU 11. FIG. 9 is a flowchart representing the process of the driver 144.

In S410 of FIG. 9, paper-type data and print data set by the design application 50 are acquired from the design application 50. Here, the design application 50 opens a print setup window prior to transferring a print request to the driver 144, enabling the user to set the type of paper to be printed on.

In S420, the acquired print data is edited. For example, a process for adjusting the printing density, a process for arranging the layout, or a raster image process (RIP) process is executed. Subsequently, the print data is converted to control codes for directly controlling the printer 20.

In S430, the paper-type data acquired in S410 is attached to the print data converted to control codes and transmitted to the printer 20. Subsequently, execution of the driver 144 ends.

Figure 10:
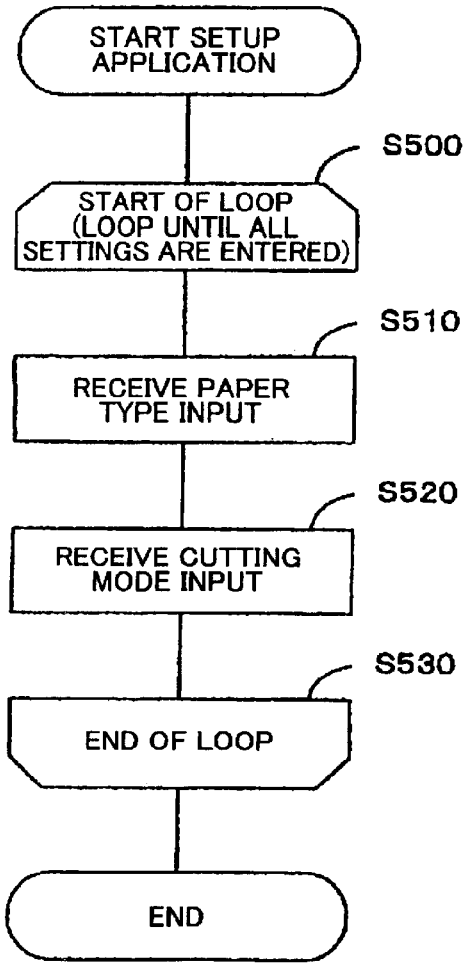
FIG. 10 is a flowchart showing steps in the setup application process according to the second embodiment.

Next, the process of the setup application 146 will be described. The setup application 146 can be executed at any time the user wishes (for example, the first time that the printer 20 is used). The user indicates a desire to execute the program using the operating panel 25. By doing so, the setup application 146 is developed in the memory 22 and executed by the CPU 21. FIG. 10 is a flowchart representing the process of the setup application 146.

To begin with, in S500, a loop setting is executed to repeatedly perform processes of S510 and S520. In S510, a message prompting the user to input a paper type is displayed on the display unit 27. After the user inputs a paper type by operating the operating panel 25, data for the paper type is added to the settings file 148.

In S520, a message prompting the user to input a cutting mode is displayed on the display unit 27. The user inputs a cutting mode by operating the operating panel 25, and data for the cutting mode is added to the settings file 148. The contents of the settings file 148 are identical to those of the settings file 48 in the first embodiment (see FIG. 4).

In S530, if there are more settings to be made for paper type and cutting mode, that is, if the above processes are to be repeated, then the process returns to S500. However, if there are no more settings to be made, then the loop is exited and execution of the setup application 146 also ends.

Figure 11:
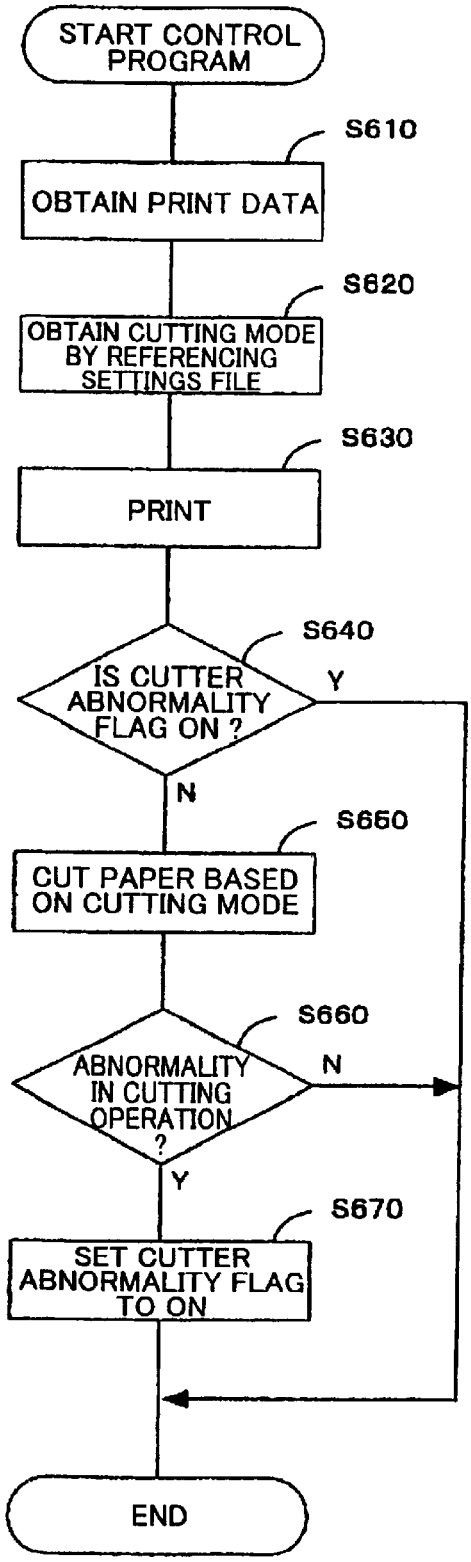
FIG. 11 is a flowchart showing the steps in the process of a control program according to the second embodiment.

Next, the control program 154 will be described with reference to FIG. 11. The control program 154 is executed by the CPU 21 when print data (converted to control codes) is transmitted from the print driver 144. It is also possible to start the control program 154 by transmitting a start command from the print driver 144 separately from the print data.

First in S610, print data (control codes) attached with the paper-type data is acquired from the print driver 144 and temporarily stored in the temporary storage unit 22*b* of the memory 22. In S620, the settings file 148 is referenced so as to obtain the cutting mode corresponding to the paper type indicated by the paper-type data attached to the print data.

In S630, the printing unit 24 is directed to perform a printing process based on the print data acquired in S610. In S640, the CPU 21 determines whether or not the cutter abnormality flag 22*c* is ON. If so (S640:YES), then execution of the control program 154 ends. However, if not (S640:NO), then the process advances to S650. Since the cutter abnormality flag 22*c* is stored in the permanent storage unit 22*a* of the memory 22, this status is preserved even when the power supply to the printer 20 is cut OFF, provided that the user does not change the value through operations of the operating panel 25.

In S650, the CPU 21 instructs the cutter 26*a* of the cutting unit 26 to cut the printed portion of the paper from the non-printed portion using the cutting method based on the cutting mode acquired in S620. In S660, the CPU 21 determines whether or not the sensor 26*b* detected some operating abnormality when the cutter 26*a* cut the paper in S650. If an abnormality was detected (S660:YES), then the process proceeds to S670. If an abnormality was not detected (S660:NO), then execution of the control program 154 ends. Abnormalities can include failure of the cutter 26*a* to return to its original position and stoppages of the cutter 26*a* for a preset length of time or more during the operation.

In S670, the cutter abnormality flag 22*c* is set to ON and a message is displayed on the display unit 27 indicating that an abnormality occurred when the cutter 26*a* was cutting the paper. Subsequently, execution of the control program 154 ends.

As in the first embodiment, the printing system 200 according to the second embodiment can reduce damage to the cutter 26*a* and paper caused by operational mistakes by the user. Since the user can set the settings file 148 using the operating panel 25, the printing system 200 is very user-friendly, facilitating the entry and modification of settings.

By including data in the settings file 148 indicating whether or not to perform a cut using the cutter 26*a*, it is possible to set the printer 20 not to perform a cut (specifically, by setting the cutting mode to "0"), thereby enabling the user to print on sheets that cannot be cut.

The printer 20 is prevented from cutting sheets after the sensor 26*b* detects an abnormality in the cutter 26*a*. If some problem occurs, for example if the cutting performance of the cutter 26*a* degrades due to wear and tear, it is possible to prevent damage to the paper or to the cutter 26*a* itself that could result from continued cutting with the cutter 26*a*.

While some exemplary embodiments of this invention have been described in detail, those skilled in the art will recognize that there are many possible modifications and variations which may be made in these exemplary embodiments while yet retaining many of the novel features and advantages of the invention.

For example, if the printer 20 is enabled to selectively print on a plurality of roll-type paper types by switching between types through software commands, it is possible to further add data to the settings file 48 indicating the paper to be printed on. In this case, the printer 20 can switch between paper types based on this data, thereby making the printer 20 even more user-friendly.

It is also possible to enable the user to set other settings that needed when cutting paper with the cutter 26*a*, such as the cutting speed, operating pressure of the cutter 26*a*, operating direction of the cutter 26*a*, operating procedure, and type of the cutter 26*a*.

Also, the settings data may include only data indicating whether or not to perform a cut.

It is also possible to store the above computer programs into a storage medium that can be read by a computer, such as a magnetic disc, an optical disc, a memory card, or the like. When required, the program can be loaded into the computer in order to direct the computer to function as the desired device. The computer program can also be loaded via a network and executed to implement the desired device. As a result, this method can facilitate updating program versions.

What is claimed is:

1. A print instructing device communicable with a printing device that performs a printing on various types of recording medium and that is provided with a cutter to cut the recording medium, the print instructing device comprising:

a storing unit that stores a plurality of data sets each indicating one of cutting operations for a corresponding type of recording medium; and a transmitting unit that transmits a print data appended with one of the data sets to a printing device, the print data instructing the printing device to perform a printing on a recording medium, the one of the data sets instructing the printing device to perform a corresponding one of the cutting operations to the recording medium.

2. The print instructing device according to claim 1, further comprising an input unit that enables a user to input data sets.

3. The print instructing device according to claim 1, wherein the data sets indicate whether or not to cut the recording medium.

4. A printing device comprising:

a receiving unit that receives a print data appended with a setting data from a print instructing device, the setting data indicating a type of recording medium and a cutting operation;

a printing unit that performs a printing operation on one of a plurality of types of recording medium, the printing unit performing the printing operation based on the print data on a recording medium of the type indicated by the setting data; and a cutting unit that performs a cutting operation to the recording medium based on the setting data.

5. The printing device according to claim 4, wherein the setting data indicates whether or not to cut the recording medium.

6. The printing device according to claim 4, further comprising a detecting unit that detects abnormalities in the cutting operation and a controller that controls the cutting unit not to perform the cutting operation when the detecting unit detects the abnormality in the cutting operation.

7. A printing device comprising:

a receiving unit that receives a print data appended with a classification data from a print instructing device, the classification data indicating one of a plurality of types of recording medium;

a printing unit that performs a printing on one of a plurality of types of recording medium, the printing unit performing, based on the print data, the printing on a recording medium of the type indicated by the classification data;

a storing unit that stores a setting data indicating cutting operations for each type of recording medium; and a cutting unit that performs one of a plurality of cutting operations to the recording medium based both on the classification data and the setting data.

8. The printing device according to claim 7, further comprising an input unit that enables a user to input the setting data.

9. The printing device according to claim 7, wherein the setting data indicates whether or not to cut a recording medium.

10. The printing device according to claim 7, further comprising a detecting unit that detects abnormalities in the cutting operation and a controller that controls the cutting unit not to perform the cutting operation when the detecting unit detects the abnormality in the cutting operation.

11. A control program of controlling a print instructing device communicable with a printing device that performs a printing on various types of recording medium and that is provided with a cutter to cut the recording medium, the control program comprising the programs of:

storing a plurality of data sets each indicating one of cutting operations for a corresponding type of recording medium; and transmitting a print data appended with one of the data sets to a printing device, the print data instructing the printing device to perform a printing on a recording medium, the one of the data sets instructing the printing device to perform a corresponding one of cutting operations to the recording medium.

12. The control program according to claim 11, wherein further comprising the program of enabling a user to input data sets.

13. The control program according to claim 11, wherein the data sets indicate whether or not to cut the recording medium.

14. A control program of controlling a printing device, the control program comprising the programs of:

receiving a print data appended with a setting data from a print instructing device, the setting data indicating a type of recording medium and a cutting operation;

controlling a printing unit to perform a printing operation based on the print data on a recording medium of the type indicated by the setting data and controlling a cutting unit to perform a cutting operation to the recording medium based on the setting data.

15. The control program according to claim 14, wherein the setting data indicates whether or not to cut the recording medium.

16. The control program according to claim 14, further comprising the programs of detecting abnormalities in the cutting operation and controlling the cutting unit not to perform the cutting operation when the abnormality in the cutting operation was detected.

17. A control program of controlling a printing device, the control program comprising the programs of:

storing a setting data indicating cutting operations for each type of recording medium;

receiving a print data appended with a classification data from a print instructing device, the classification data indicating one of a plurality of types of recording medium;

controlling a printing unit to perform, based on the print data, a printing on a recording medium of the type indicated by the classification data; and controlling a cutting unit to perform one of a plurality of cutting operations to the recording medium based both on the classification data and the setting data.

18. The control program according to claim 17, further comprising the program of enabling a user to input the setting data.

19. The control program according to claim 17, wherein the setting data indicates whether or not to cut a recording medium.

20. The control program according to claim 17, further comprising the programs of detecting abnormalities in the cutting operation and controlling the cutting unit not to perform the cutting operation when the detecting unit detects the abnormality in the cutting operation.

21. A print system comprising:

a print instructing device; and a printing device, wherein the print instructing device includes:

a storing unit that stores a plurality of data sets each indicating one of cutting operations for a corresponding type of recording medium; and a transmitting unit that transmits a print data appended with one of the data sets to the printing device, and the printing device includes:

a receiving unit that receives the print data appended with the one of the data sets;

a printing unit that performs a printing operation on one of a plurality of types of recording medium, the printing unit performing, based on the print data, the printing operation on a recording medium of the type indicated by the one of the data sets; and a cutting unit that performs the one of the plurality of cutting operations to the recording medium, the one of the plurality of cutting operations being indicated by the one of the data sets.

22. The print system according to claim 21, wherein the print instructing device further includes an input unit that enables a user to input the data sets.

23. The print system according to claim 21, wherein the data sets indicate whether or not to cut the recording medium.

24. The print system according to claim 21, wherein the printing device further includes a detecting unit that detects abnormalities in the cutting operation and a controller that controls the cutting unit not to perform the cutting operation when the detecting unit detects the abnormality in the cutting operation.

25. A print system comprising:

a printing device; and a print instructing device including a transmitting unit that transmits a print data appended with a classification data to the printing device, the classification data indicating one of a plurality of types of recording medium to be printed on, wherein the printing device includes:

a receiving unit that receives the print data appended with the classification data;

a storing unit that stores a setting data indicating cutting operations for each type of recording medium;

a printing unit that performs a printing on one of a plurality of types of recording medium, wherein the printing unit performs, based on the print data, the printing on a recording medium of the type indicated by the classification data; and a cutting unit that performs one of a plurality of cutting operations to the recording medium based both on the classification data and the setting data.

26. The print system according to claim 25, wherein the printing device further includes an input unit that enables a user to input the setting data.

27. The print system according to claim 25, wherein the setting data indicates whether or not to cut a recording medium.

28. The print system according to claim 27, wherein the printing device further includes a detecting unit that detects abnormalities in the cutting operation and a controller that controls the cutting unit not to perform the cutting operation when the detecting unit detects the abnormality in the cutting operation.

* * * * *